United States Patent [19]

Parsons

[11] Patent Number: 4,869,215

[45] Date of Patent: Sep. 26, 1989

[54] CAM MECHANISMS

[75] Inventor: Bryan N. V. Parsons, Stoney Stanton, England

[73] Assignee: Jaguar Cars Limited, England

[21] Appl. No.: 196,931

[22] Filed: May 20, 1988

[30] Foreign Application Priority Data

May 21, 1987 [GB] United Kingdom ..... 8711993

[51] Int. Cl.[4] ..... F01L 1/14

[52] U.S. Cl. ..... 123/90.16; 123/90.48

[58] Field of Search ..... 123/90.16, 90.27, 90.28, 123/90.48

[56] References Cited

U.S. PATENT DOCUMENTS

| | | | |
|---|---|---|---|
| 1,501,041 | 7/1924 | Cutler | 123/90.48 |
| 2,663,288 | 12/1953 | Hutchison | 123/90.16 |
| 2,933,949 | 4/1960 | Bouwkamp | 123/90.48 |
| 4,261,307 | 4/1981 | Oldberg | 123/90.15 |

FOREIGN PATENT DOCUMENTS

| | | | |
|---|---|---|---|
| 544741 | 2/1932 | Fed. Rep. of Germany . | |
| 2938283 | 4/1981 | Fed. Rep. of Germany | 123/90.48 |
| 1245669 | 4/1902 | France . | |
| 326921 | 6/1903 | France . | |
| 543706 | 9/1922 | France . | |
| 955988 | 4/1964 | United Kingdom . | |
| 1496513 | 3/1974 | United Kingdom . | |
| 2017207 | 2/1979 | United Kingdom . | |
| 2038985 | 11/1979 | United Kingdom . | |

*Primary Examiner*—Charles J. Myhre
*Assistant Examiner*—Weilun Lo
*Attorney, Agent, or Firm*—Davis, Bujold & Streck

[57] ABSTRACT

A cam mechanism includes a cam of basic circular formation and having a lobe formation extending radially outwardly along part of its periphery; and a cam follower mounted for reciprocating movement along an axis perpendicular to the axis of rotation of the cam; the cam acting against an end face of the cam follower so that engagement of the lobe formation therewith will cause movement of the cam follower, the inclination of the face of the cam follower which is engaged by the lobe formation being adjustable to vary the duration of movement of the cam follower by the cam.

6 Claims, 5 Drawing Sheets

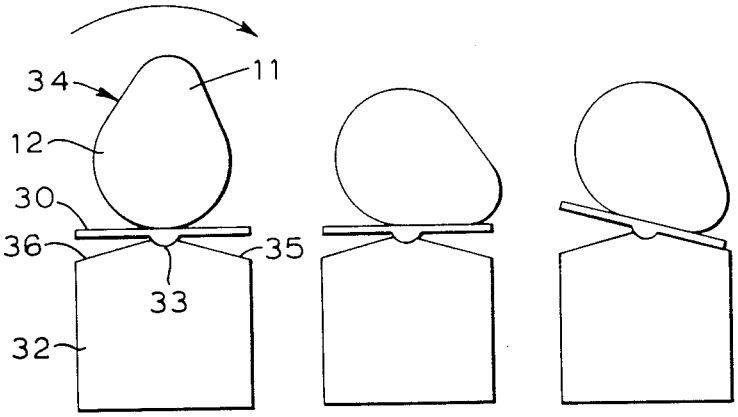
FIG 6A
FIG 6B
FIG 6C
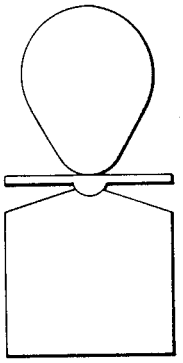
FIG 6D
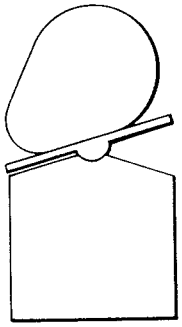
FIG 6E
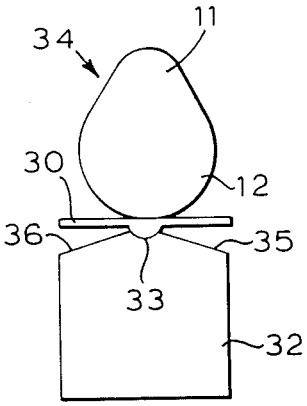
FIG 6F

CAM MECHANISMS

BACKGROUND TO THE INVENTION

The present invention relates to cam mechanisms and, in particular, although not exclusively, to cam mechanisms used to control the inlet and exhaust valves of internal combustion engines.

Modern high performance internal combustion engines have been developed to give a maximum power output at high engine speeds. In order to achieve this, the profile of the cam controlling opening and closing of the valves is designed to give high lift with long duration, in order to encourage gas flow at high speeds.

With such designs, the gas flow at low engine speeds is very much compromised. Under such conditions, incoming air is spilled back into the manifold, due to late closing of the inlet valve, producing a corresponding reduction in the torque output available at low speeds. Also, the exhaust gas is released too early, reducing the expansion ratio of the engine and hence its efficiency. Furthermore, the overlap period where both inlet and exhaust valves are open, is too large and allows free flow of air and fuel through the exhaust valve, thus causing emission problems.

The present invention provides cam mechanism which may be adjusted in accordance with the engine speed, to vary the duration of opening of the valves.

SUMMARY OF THE INVENTION

According to one aspect of the present invention, a cam mechanism comprises; a cam of basic circular formation and having a lobe formation extending radially outwardly along part of its periphery; and a cam follower mounted for reciprocating movement along an axis perpendicular to the axis of rotation of the cam; the cam acting against an end face of the cam follower so that engagement of the lobe formation therewith will cause movement of the cam follower, means being provided for adjustment of inclination of the end face of the cam follower to adjust the angular positions at which the lobe formation engages and disengages the end face and thus the duration of movement of the cam follower.

BRIEF DESCRIPTION OF DRAWINGS

Various embodiments of the invention are now described, by way of example only, with reference to the accompanying drawings, in which:

FIGS. 6A to 6F show sequential positions of the cam and cam follower illustrated in FIG. 5 as the cam rotates;

DESCRIPTION OF PREFERRED EMBODIMENTS

Figure 1:
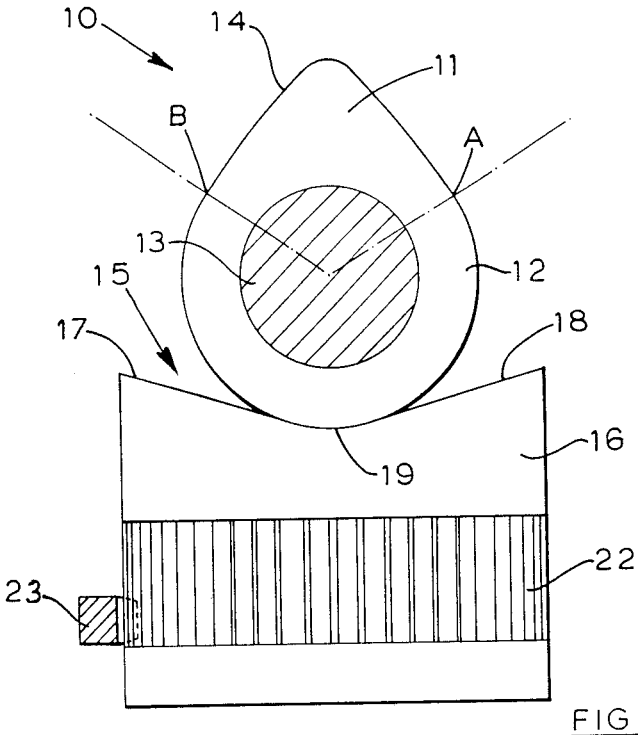
FIG. 1 illustrates in front elevation a cam mechanism formed in accordance with the present invention.
Figure 2:
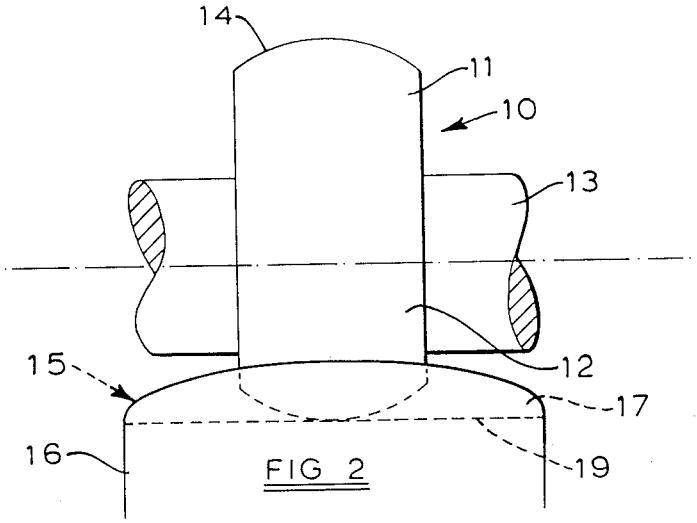
FIG. 2 illustrates in side elevation the cam mechanism shown in FIG. 1.

The cam mechanism illustrated in FIGS. 1 to 4 includes a cam 10 having a lobe formation 11 which projects from a basic circular formation 12. The cam 10 is mounted on or formed as a part of a camshaft 13, for rotation therewith. The surface 14 of the cam 10 engages the end face 15 of a bucket follower 16. The bucket follower 16 is slidingly located perpendicular to the axis of rotation of the cam 10, in a cylindrical bucket guide (not shown) and in the conventional manner would engage the end of the stem of a poppet valve, so that upon rotation of the cam 10, the lobe formation 11 will open and close the poppet valve.

The end face 15 of the bucket follower 16 is profiled, having a pair of flat surfaces 17 and 18 which are inclined to the axis of the bucket guide, these surfaces being smoothly interconnected by a diametrical arcuate surface 19, of radius equal to the radius of the cam base circle 12.

The surface 14 of the cam 10 is radiussed across its width, to a radius equal or smaller than the radius of the cam base circle 12. The cam 10 can thus engage the profiled face 15 of bucket follower 16, at any orientation of the bucket follower 16. Means (not shown) is provided for rotation of the bucket follower 16 in its guide, so that orientation of the profiled face 15 thereof, may be varied with respect to the cam 10. This means may be in the form of a rack and pinion mechanism, a rack 23 being mounted transversely of the bucket follower 16 and engaging teeth 22 formed thereon, so that axial movement of the rack 23 will cause rotation of the bucket follower 16. Axial movement of the rack 23 will preferably be controlled by appropriate means in response to the engine speed.

Figure 3:
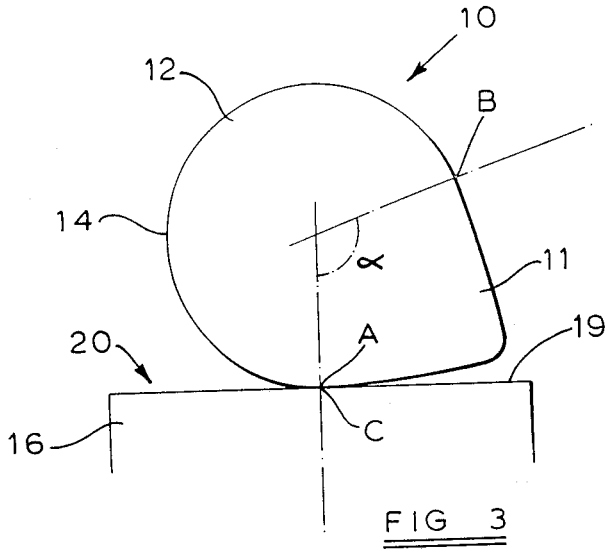
FIGS. 3 and 4 illustrate sections of the cam mechanism illustrated in FIG. 1, with the cam follower at different orientations to the cam.

As illustrated in FIG. 3, when the bucket follower 16 is positioned so that the diametrical arcuate surface 19 is perpendicular to the axis of rotation of the cam 10, the cam 10 will engage an effectively flat surface 20. In this position, the cam 10 will commence to move the bucket follower 16 and hence begin to open the valve, when the start of the lobe formation 11 (point A) engages the flat surface 20 at point C and will hold the valve open until the end of the lobe formation 11 (point B) engages the flat surface 20 at point C. The bucket follower 16 will be moved and the valve will consequently be held open for movement of the cam 10 through an angle $\alpha$.

When the bucket follower 16 is rotated through 90° so that the diametrical arcuate surface 19 is parallel to the axis of rotation of cam 10, the cam surface 14 will engage profiled surface 21. In this position, the cam 10 will begin to move the bucket follower 16 when the start of lobe formation 11 (point A) engages the flat surface 18 at point D and will return to its initial position when the end of the lobe formation (point B) engages the flat surface 17 at point E. The bucket follower 16 will consequently be moved by lobe formation 11 of cam 10, and the valve will be held open, for rotation of the cam 10 over an angle $\alpha+\beta$.

Figure 4:
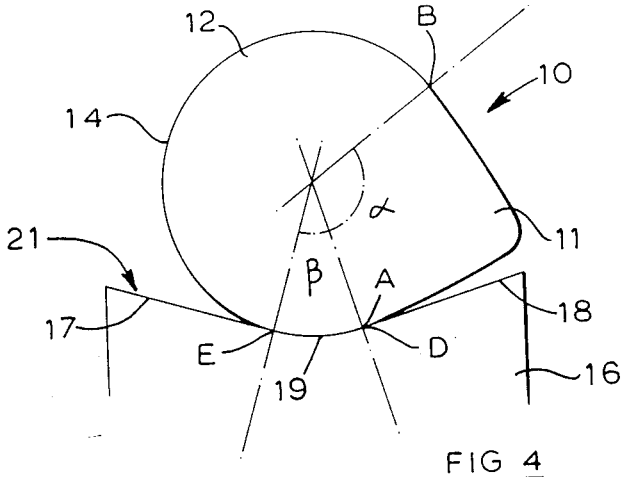

Duration of movement of the bucket follower 16 between $\alpha$ and $\alpha+\beta$ may be achieved by rotating the bucket follower 16, so that the face 15 is orientated at angles intermediate of those illustrated in FIGS. 3 and 4. Furthermore, the angle of inclination of the surfaces 17 and 18 will determine the position of points D and E and consequently by having different angles of inclination, the opening and closing points of the valve may be moved, thus altering the phase relationship between rotation of the cam 10 and opening and closing of the valve.

Figure 5:
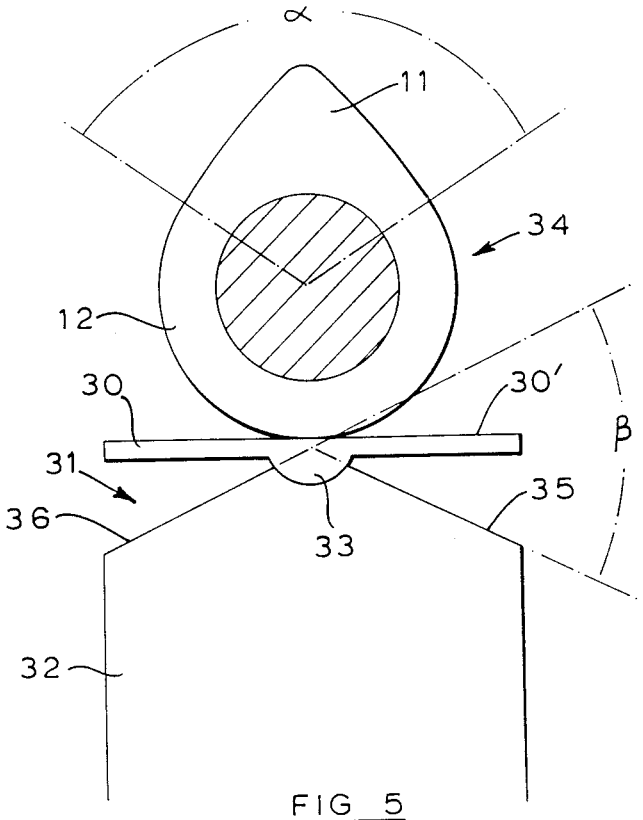
FIG. 5 illustrates a alternative form of cam mechanism.

In the cam mechanism illustrated in FIG. 5, a disc 30 is pivotally mounted on the end face 31 of a bucket follower 32 on a diametrical pivot 33, the virtual centre of the pivot 33 being at or near the upper surface 30' of the disc 30, where it is engaged by a cam 34. The end face 31 of bucket follower 32 has a pair of flats 35, 36 which are inclined from the pivot 33 away from disc 30, so as to permit the disc 30 to seesaw about pivot 33. As illustrated in FIGS. 6A to 6F, when the pivot 33 is aligned so that it is parallel to the axis of rotation of the cam 34, rotation of the cam 34 will cause movement of the bucket follower 32 through the following stages:

1. When the cam 34 is running with its base circle 12 in engagement with the disc 30 (as illustrated in FIG. 6A) the disc 30 is held normal to the axis of the bucket follower 32 constrained by both the bucket follower 32 and the cam 34, until the lobe formation 11 engages the disc 30 (as illustrated in FIG. 6B);
2. Further rotation of the cam 34 will cause disc 30 to pivot until it is seated against the inclined face 35 (as illustrated in FIG. 6C);
3. Further rotation of cam 34 will cause the bucket follower 32 to move downwardly until at its maximum movement the nose of lobe formation 11 will engage the disc 30 at its virtual centre (as illustrated in FIG. 6D);
4. The disc 30 will then flip over to engage inclined face 36 and continued rotation of the cam 34 will allow the bucket follower 32 to move upwardly, until it is restored to its original position (as illustrated in FIG. 6E);
5. Continued rotation of the cam 34 back on its base circle diameter 12 will bring disc 30 back to its initial position (as illustrated in FIG. 6F).

The duration of movement of the bucket follower 32 will consequently correspond to rotation of the cam 34 through angle $\alpha-\beta$, where $\alpha$ is the angle subtended by the lobe formation 11 and $\beta$ is the difference in angles of inclination of faces 35 and 36.

If the bucket follower 32 is now rotated through 90°, so that the axis of rotation of cam 34 is parallel to the diametrical pivot 33, as the cam 34 rotates against disc 30, the disc 30 will be unable to pivot relative to the bucket follower 32 and consequently the cam 34 will operate against a flat surface in a manner similar to that indicated in FIG. 3. The duration of movement of the bucket follower 32 will consequently correspond to rotation of the cam through an angle $\alpha$.

Also as with the embodiment described with reference to FIGS. 1 to 4, provided that the cam surface 14 is radiussed across its width to permit tilting of the disc 30, durations corresponding to angles intermediate of $\alpha$ and $\alpha-\beta$ may be achieved by rotating the bucket follower 32, so that the pivot 33 is orientated at intermediate angles. Alternatively, the above mechanism may be operated at only the two extreme positions discussed above, the orientation of the pivot being switched at a selected engine speed. If used in this manner, the cam surface 14 need not be radiussed across its width.

As with the embodiment described with reference to FIGS. 1 to 4, the angles of inclination of faces 35 and 36 may be varied to vary the opening and closing positions of a valve controlled by bucket follower 32. Where the bucket followers are rotated, this may also be achieved in a manner similar to that described with reference to FIGS. 1 to 4.

Figure 7:
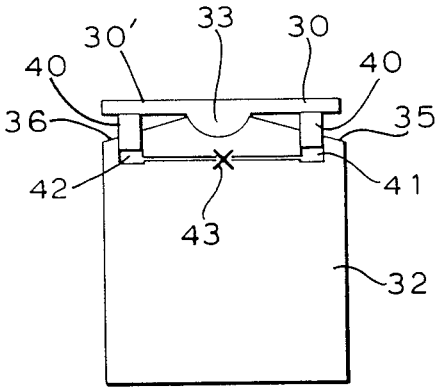
FIG. 7 illustrates a modification to the cam mechanism shown in FIG. 5.
Figure 8:
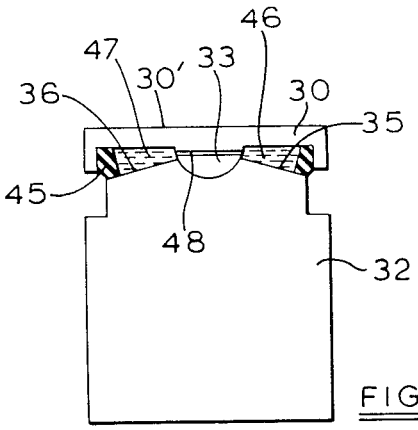
FIG. 8 illustrates an alternative modification to the cam mechanism illustrated in FIG. 5.

In the embodiments illustrated in FIGS. 7 and 8, damping elements control movement of the pivotted disc 30. The force required to move the bucket follower 32 is proportional to the square of the speed plus an initial pre-set value for seating an associated valve, while the damper elements would produce a force proportional to the speed. The damper elements can thus be arranged at some pre-determined speed, to provide a force greater than that required to move the bucket follower 32, so that at speeds below the pre-determined speed, the bucket follower 32 will not begin to move until the disc 30 engages the inclined face 35, while above the pre-determined speed, the bucket follower 32 will begin to move when disc 30 is at some position intermediate of its horizontal position and the position in which it seats against the inclined face 35, thus increasing the duration of movement of the bucket follower 32, without the need to rotate the bucket follower 32.

In the embodiment illustrated in FIG. 7, the damping elements are provided by a pair of pistons 40 which are pivotally attached one on either side of the disc 30, these pistons engaging in cylinders 41,42 in the end of bucket follower 32, the cylinders 41,42 being interconnected with a restrictor 43, so that as the disc 30 pivots hydraulic fluid in one cylinder will be forced through restrictor 43 into the other cylinder to provide a damping action.

In the alternative embodiment illustrated in FIG. 8, an annular rubber seal 45 is provided between the disc 30 and the end face 15 of bucket follower 32 to provide a pair of fluid chambers 46 and 47 between the disc 30 and end face 15, these chambers 46 and 47 being separated by the diametrical pivot 33 and being interconnected by a restricted orifice 48 passing through the pivot 33, so that upon pivotal movement of the disc 30 hydraulic fluid will be forced from one chamber to the other. A similar effect may be achieved by positioning a ring of suitable elastomeric composition between the disc 30 and the end face of the bucket follower 32.

In a further embodiment, rather than interconnecting the cylinders 41 and 42 of the embodiment illustrated in FIG. 7, these may be connected to a source of hydraulic fluid, the pressure of which may be controlled in relationship to the speed of the engine, so that movement of the disc 30 and hence the duration of movement of the bucket follower 32 may be controlled to provide a continuous variation without the need to rotate the bucket follower 32.

In conventional cam mechanisms of this type, shims are provided between the bucket follower 32 and the end of the valve stem in order to adjust the valve clearance. With the embodiments illustrated in FIGS. 5 to 8 in place of shims, the thickness of the disc 30 could be varied to provide the required clearance.

While the invention has been described so far with reference to individual cam mechanisms, it is likely that several such mechanisms would be used together. Where the cam mechanisms include rotatable followers, rotation of all the followers may be controlled by a common device, for example rack mechanism. However, it is preferable to rotate the followers when they are engaged by the base circles of the cams. It may consequently be necessary to employ individual or at least two or more common mechanisms for this purpose.

I claim:

1. A cam mechanism comprising a cam of basic circular formation and having a lobe formation extending radially outwardly along part of the periphery; and a cam follower mounted for reciprocating movement along an axis perpendicular to the axis of rotation of the cam; the cam acting an end face of the cam follower so that engagement of the lobe formation therewith will cause movement of the cam follower, means being provided for adjustment of inclination of the end face of the cam follower to adjust the angular positions at which the lobe formation engages and disengages the end face and thus the duration of movement of the cam follower, the end face of the cam follower being generally concave.

2. A cam mechanism according to claim 1 in which, means are provided for varying the orientation of the generally concave face with respect to the axis of rotation of the cam.

3. A cam mechanism according to claim 2 in which the end face of the cam follower has a pair of flat surfaces inclined outwardly towards the cam, said flat surfaces being smoothly interconnected by a diametrical arcuate surface of radius equal to the radius of the base circle diameter of the cam.

4. A cam mechanism according to claim 2 in which means is provided for rotation of the cam follower.

5. A cam mechanism according to claim 4 in which the cam follower may be rotated about its axis to any orientation relative to the cam, the cam being radiussed across its width in a plane including the axis of rotation of the cam to accommodate varying inclination of the surface of the cam follower with which it engages.

6. A cam mechanism according to claim 5 in which the cam follower may be rotated from one position in which the cam engages an effectively flat surface on the cam follower, to a second position in which the cam is disposed normal to an inclined surface on the cam follower.

* * * * *